United States Patent [19]

Okayasu

[11] Patent Number: 4,792,283

[45] Date of Patent: Dec. 20, 1988

[54] HEAT-DRIVEN PUMP

[76] Inventor: Kenji Okayasu, 20-15, Mukai-machi, Gyouda-shi, Saitama, Japan

[21] Appl. No.: 65,322

[22] Filed: Jun. 22, 1987

[30] Foreign Application Priority Data

Jun. 23, 1986 [JP] Japan ..... 61-144783

[51] Int. Cl.[4] ..... F04B 19/24

[52] U.S. Cl. ..... 417/52; 417/209

[58] Field of Search ..... 417/207, 208, 209, 52, 417/379

[56] References Cited

U.S. PATENT DOCUMENTS

| | | | |
|---|---|---|---|
| 2,914,217 | 11/1959 | Warhus | 417/209 X |
| 2,953,100 | 9/1960 | Andrews | 417/209 |
| 4,212,593 | 7/1980 | Wilhite | 417/209 X |
| 4,625,790 | 12/1986 | Okayasu | 417/209 X |

FOREIGN PATENT DOCUMENTS

| | | | |
|---|---|---|---|
| 31679 | 2/1986 | Japan | 417/209 |

*Primary Examiner*—Leonard E. Smith

*Attorney, Agent, or Firm*—Michael N. Meller

[57] ABSTRACT

A heat-driven pump for performing the transport of liquid by the function of bubbles produced by vaporization and condensation of the liquid under heating includes an inlet pipe, an inlet-side check valve, a charging pipe, a bubble forming portion, a discharging pipe, an outlet-side check valve, and an outlet pipe. The bubbles forming portion includes a heating portion for receiving heat supplied from outside, a liquid cavity formed in the heating portion having a cross-sectrion which is reduced along the longitudinal axis of the heating portion, and a vapor-liquid exchange chamber communicated with the liquid cavity and having a volume greater than the volume of a bubble extruded from the liquid cavity. In this heat-driven pump, a bubble is generated and expanded in the liquid cavity by heat received by the heating portion, a discharge of liquid is carried out by the expansion of the bubble, an introduction of new liquid into the liquid cavity is carried out by extrusion of the bubble into the vapor-liquid exchange chamber, and elimination of the bubble is carried out by a cooling of the heating portion, and accordingly, a successive pumping of liquid is carried out.

7 Claims, 11 Drawing Sheets

HEAT-DRIVEN PUMP

BACKGROUND OF THE INVENTION

1. Field of the Invention

The present invention relates to a heat-driven pump. The heat-driven pump of the present invention can be used for a pump for a room heater in a house or a building. Further, the heat-driven pump of the present invention can be used as a pump which utilizes a high temperature waste of heat discharged from a factory or a plant. Furthermore, the heat-driven pump of the present invention can be used in a remote part of the country where it is difficult to supply electric power.

2. Description of the Related Arts

Known in the art is a heat-driven pump in which the pumping action is caused by an alternate vaporization and condensation of liquid, and in which an external power device such as a motor or compressor is not required (e.g. "Heat-Driven Pump", Soda and Chlorine Magazine, 1983, No. 2, pp 64–77).

However, this heat-driven pump has an unsatisfactory performance upon starting or if an insufficient amount of heat per hour is available, which is usually caused by the use of a long copper pipe for the heating portion. This is because, in order to generate a vapor bubble from the surface of the wall of the pipe and expand the vapor bubble toward the center of the pipe, it is necessary to raise the temperature of the liquid, even the temperature of the central portion of the liquid, close to the saturation temperature of the liquid. Accordingly, a temperature of a discharged liquid is raised to an approximate saturation point and heats a pipe close to the exit of the heating portion after the pump has been in operation for sometime. In particular, when an hourly heat amount is low, the liquid temperature to the approximate saturation point cannot be quickly elevated, and therefore, because of an accompanying thermal conductivity effect from the heating portion piping, a temperature of the pipe nearest the exit of the heating portion is raised to about the liquid saturation temperature, but a vapor bubble generated at the heating portion prevents a cooling of the exit side piping. Thus, the vapor bubble is not properly condensed, and finally, the pumping action is brought to a halt. Further, a heat-driven pump of this type has a low pumping efficiency, because although a large portion of an energy is applied to the pump to heat the liquid, only a small portion of this energy can be used to create a pumping action. Further, it is required that the heat-driven pump should include two heating pipes, and the heat-driven pump should be installed on a horizontal plane.

Japanese Unexamined Patent Publication (Kokai) No. 61-31679 discloses a heat-driven pump wherein the problems described above are alleviated. Namely, in the disclosed heat-driven pump, a heating portion is shaped to facilitate the generation of vapor bubbles, and is thermally isolated from other portions of the pump. This arrangement expedites the generation of vapor bubbles, and therefore, a liquid flow rate is increased and the temperature of the discharged liquid is lowered, and thus a temperature of the outlet side piping is also lowered. Further, according to the disclosure, bubbles are easily and frequently developed and condensed, ensuring an increased flow rate and a reduced temperature, and thus a preferable cycle of functions by which the heat-driven pump achieves a smooth operation by a small or a large amount of heat is realized.

However, even in the above mentioned heat-driven pump, a vapor bubble is expanded into an outlet piping to exert a high pressure load on the external portion, and when the heat quantity of the heating is small, a bubble is expanded only slowly into the piping, thus heating the piping and preventing the bubble from being condensed. Further, since the pump provides an intake portion for bringing the expanded bubble into the condensation process by means of the capillary action, there remain problems in dealing with the needs for a heat-driven pump for a large flow rate.

SUMMARY OF THE INVENTION

An object of the present invention is to provide a heat-driven pump having an improved efficiency. Another object of the present invention is to provide a heat-driven pump capable of stable operation under an external pressure load, by a small or a large amount of heat. Yet another object of the present invention is to provide a heat-driven pump having a relatively simple structure and able to meet a large flow demand.

In accordance with the present invention, there is provided a heat-driven pump for transporting a liquid by the function of bubbles produced by vaporization and condensation of the liquid under heating, in which the pump comprises, in the following sequence: an inlet pipe; an inlet-side check valve; a charging pipe; a bubble forming portion; a discharge pipe; and an outlet pipe. The bubble forming portion comprising a heating portion for receiving heat supplied from outside; a liquid cavity formed in the heating portion and having a cross-section which is reduced along the longitudinal axis of the heating portion; and a vapor-liquid exchange chamber communicated with the liquid cavity and having a volume greater than the volume of a bubble extruded from the liquid cavity; in which a bubble is generated and expanded in the liquid cavity by heat received by the heating portion, the discharge of liquid is carried out by the expansion of the bubble, the introduction of fresh liquid into the liquid cavity is carried out by extrusion of the expanded bubble into the vapor-liquid exchange chamber, and the elimination of the bubble is carried out by cooling the heating portion by the introduction of the fresh liquid, whereby a successive pumping of the liquid is carried out.

DESCRIPTION OF THE PREFERRED EMBODIMENTS

Figure 1:
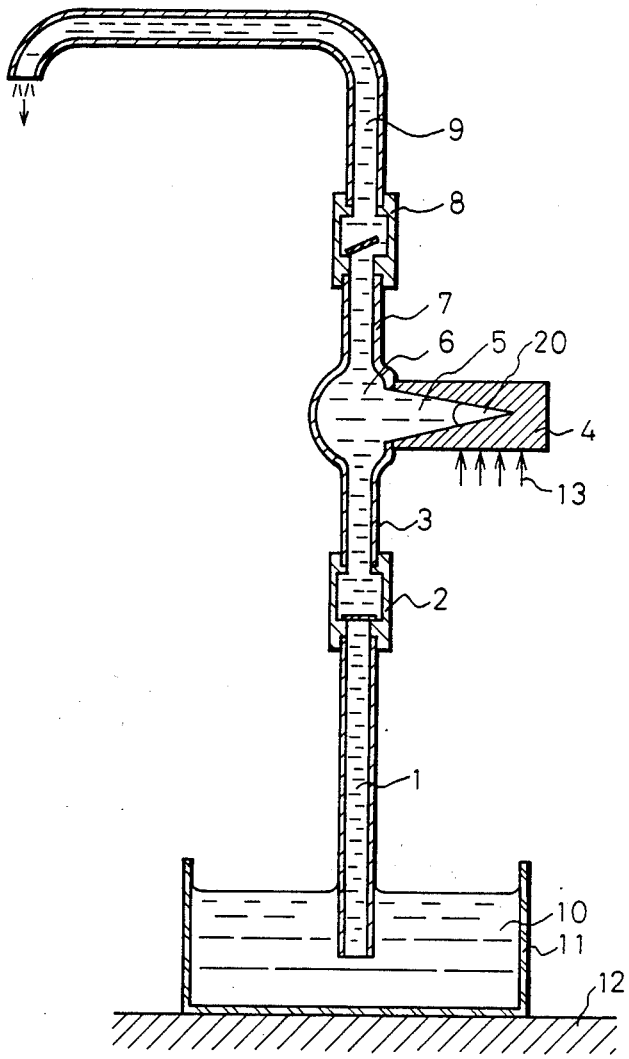
FIG. 1 shows a heat-driven pump according to an embodiment of the present invention.

FIG. 1 shows an embodiment of the present invention, in which a heating portion 4 includes a cone-shaped liquid cavity 5 having a cross-section which is reduced along the longitudinal axis of the heating portion 4, and an opening portion connected to a vapor-liquid exchange chamber 6. The liquid cavity 5 is parallel to the horizontal plane in FIG. 1 but may be substantially perpendicular to or aslant the horizontal plane. A charging pipe 3 into which a liquid 10 flows is provided with an inlet-side check valve 2, and a discharging pipe 7 from which the liquid 10 flows is provided with an outlet-side check valve 8; both pipes 3 and 7 being connected to the vapor-liquid exchange chamber 6, and further, both check valves permitting a liquid flow in only one direction. The liquid 10 is drawn from the reservoir 11 into the pump through an inlet pipe 1, and after heating, the liquid 10 is discharged from the pump through an outlet pipe 9. The arrows 13 show the positions at which heat is applied from outside.

Figure 2:
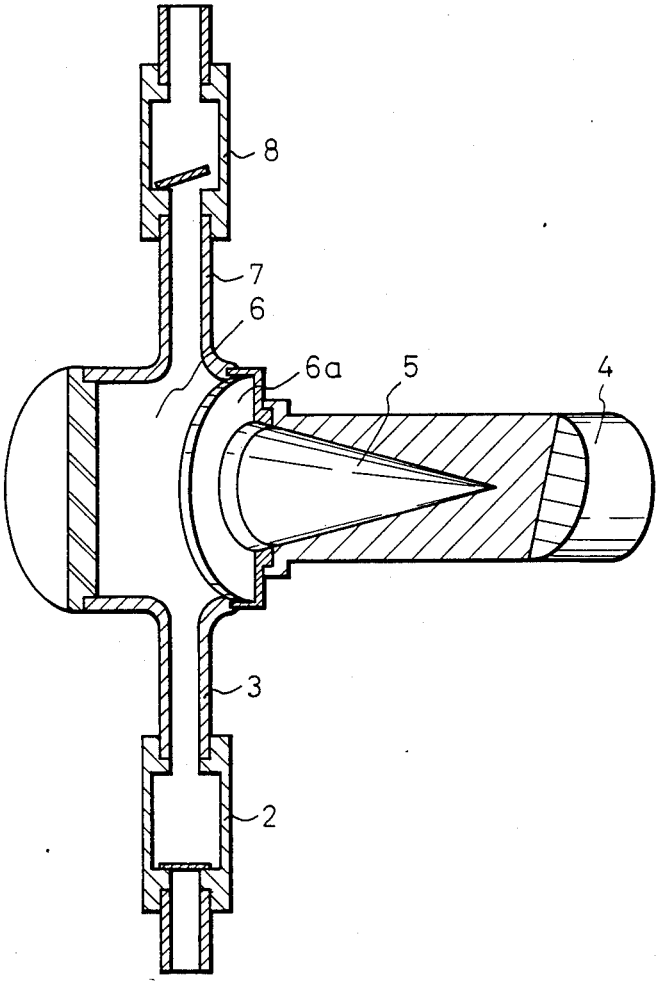
FIG. 2 is a cross-sectional detailed view of the structure of the main portion of the device shown in FIG. 1.

FIG. 2 shows a detailed structure of the main portion of the pump shown in FIG. 1. The heating portion 4 is made of copper, which uniformly and effectively conducts the heat applied from outside to the cone-shaped liquid cavity 5. The vapor-liquid exchange chamber 6 is made of glass so that the heat from the heating portion is not conducted to the liquid 10 inside the vapor-liquid exchange chamber 6 through the walls thereof. A ring 6*a* made of Kovar alloy, which has a thermal expansion coefficient similar to glass, is fuse-welded at one side thereof to the glass wall of the vapor-liquid exchange chamber 6, and at the other side, is soldered to the copper wall of the heating portion 4. Therefore, the ring 6*a* absorbs the difference in thermal expansion between copper and glass, and thus stress due to the difference in the thermal expansion coefficient does not occur in the glass wall of the vapor-liquid exchange chamber 6. Further, the thermal conductivity of the Kovar alloy of the ring 6*a* is very much lower than that of copper, preventing a conduction of the heat from the heating portion to the liquid 10 and the vapor-liquid exchange chamber 6, which are both in contact with the ring 6*a*, and thus preventing an undue increase in the temperature of the vapor-liquid exchange chamber 6.

The inlet pipe 3, the outlet pipe 7, and the vapor-liquid exchange chamber 6 are formed as one unit, and the inlet-side check valve 2 and the outlet-side check valve 8 are provided at the ends of the inlet pipe 3 and outlet pipe 7 respectively, in such a manner that the liquid flow is allowed in only one direction. The check valves 2 and 8 are flap type valves having a high pressure sensitivity.

Figure 3:
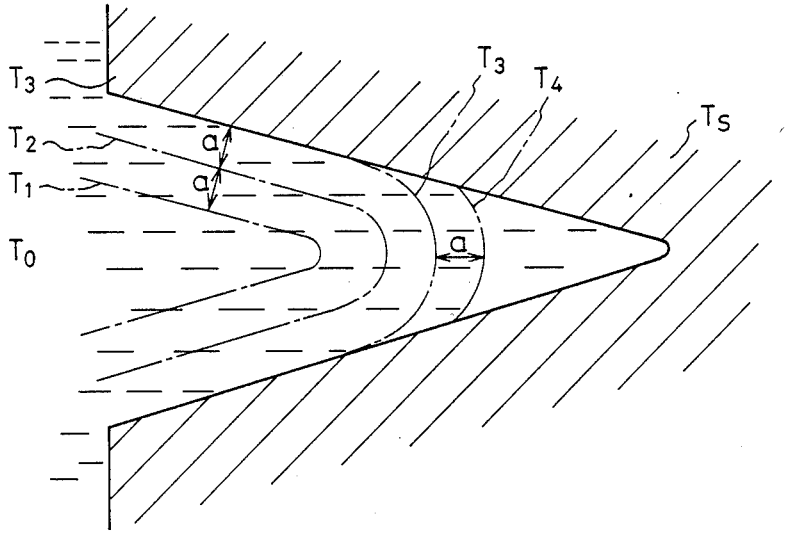
FIG. 3 is a cross-sectional view of the liquid cavity of the device shown in FIG. 1.

The operation of the pump shown in FIG. 1 is now described with reference to FIGS. 3 through 9. FIG. 3 is a enlarged cross-sectional view of the liquid cavity 5.

The isothermal lines $T_1$–$T_4$ shown in FIG. 3 indicate the thermal distribution of the liquid when the heating portion 4 is subjected to the heat from outside and the temperature of the liquid in the liquid cavity 5 is rising, and vapor bubbles are not produced. $T_o$ indicates the temperature inside the vapor-liquid exchange chamber 6, and $T_s$ is the temperature of entire heating portion 4, which is higher than the saturation temperature of the liquid.

Since the heating portion 4 is made of a material having a good thermal conductivity, such as copper, the temperature $T_s$ inside the heating portion 4 is considered uniform. The heat is transmitted to the liquid by thermal conductivity from the surface of the heating portion 4 in contact with the liquid. Since the thermal conductivity of that surface is very low, a sharp thermal gradient exists. Further, the thermal conduction to the inside of liquid is at a corresponding thermal gradient, because of the low thermal conductivity of the liquid. At this time, the heat is conducted perpendicularly from the wall surface of the liquid cavity 5, and thus a thermal distribution which is reduced along the perpendicular distance "a" from the wall surface may be assumed.

When the above concept is applied to the wall surface of the liquid cavity 5, the isothermal line having the lowest temperature will cross at a point farthest from the tip of the liquid cavity. However, the isothermal line does not cross at this point, but crosses with a curvature corresponding to the wall surface, as shown in FIG. 3. This shows the temperature of the liquid becomes higher close to the tip portion of the liquid cavity than at any other portion. In other words, since the liquid inside the liquid cavity 5 is heated evenly by the surrounding wall surface, the temperature at the tip portion having a short radius should be higher than at any other portion.

Accordingly, if the isothermal line $T_4$ shows the saturation temperature of the liquid, a vapor bubble can be always produced at the wall surface beyond the $T_4$ line. When the heat is transmitted from the wall surface to the liquid, some of the heat may be circulated by convection, but in this case, the time period from when the cavity is filled with liquid to the generation of a bubble at the tip portion is too short to allow any considerable effect of convection.

Figure 4:
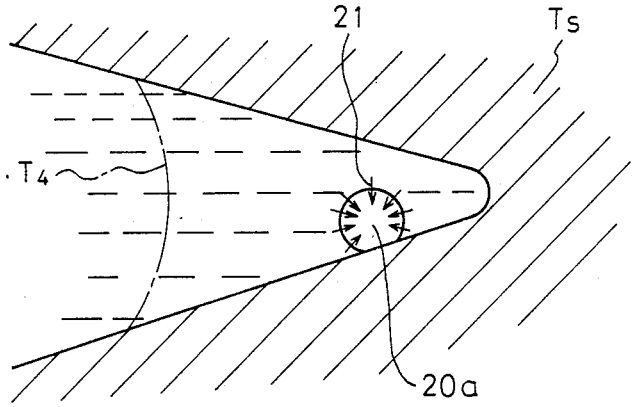
FIGS. 4 through 9 show the states from the generation of a bubble in the liquid cavity to the elimination of the bubble.

FIG. 4 is a enlarged schematic view of the tip portion of the liquid cavity, showing a small bubble 20*a* generated with the wall surface as the origin of the bubble generation. The temperature of the liquid around the bubble is higher than the saturation temperature, and thus the surrounding liquid is vaporized and drawn into the bubble, causing the bubble to grow.

Figure 5:
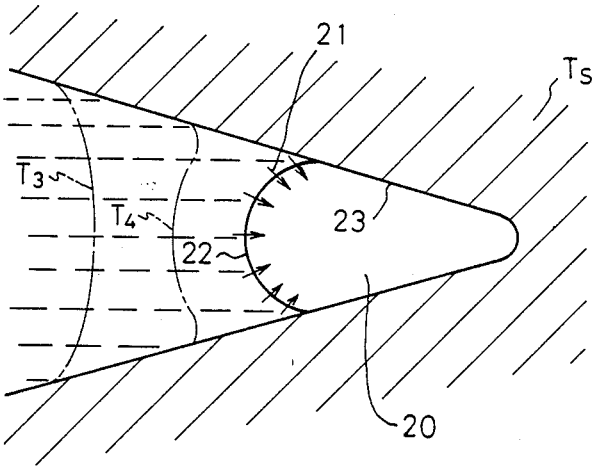

As shown in FIG. 5, the bubble 20 continues to grow, and the border surface 22 between the vapor and the liquid separates the vapor and the liquid. The arrows 21 show the entry of the vaporized liquid into the bubble. Due to this vaporization, the bubble continues to grow, and the border surface 22 between the liquid and the vapor moves to the left in FIG. 5, against the external pressure of the liquid.

Figure 6:
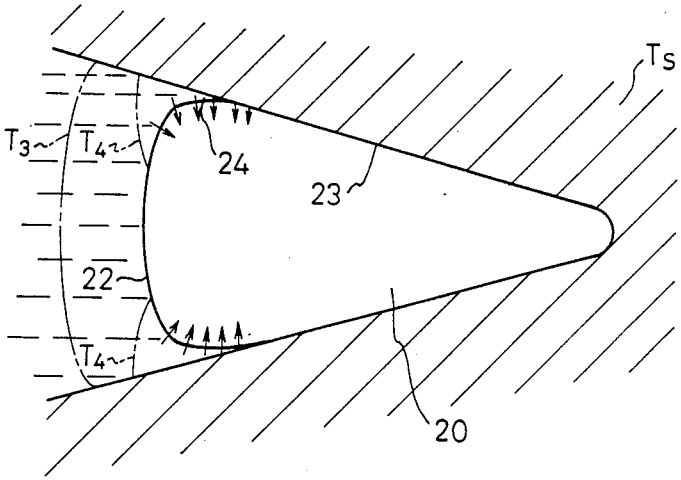

In FIG. 6, the bubble continues to grow, and the area of the border surface 22 between the vapor and the liquid correspondingly expands, and accordingly, the portion of the liquid having a temperature higher than $T_4$ and adjacent to the border surface 22 between the vapor and the liquid is expanded and forms a thin layer which is cooled by the cooler portion of the liquid located at the left in FIG. 6, below the saturation point, and thus the entry of vapor through the border surface 22 between the vapor and the liquid is almost eliminated. Instead, a thin layer 24 of the liquid having a wedge-shaped cross-section, which is easily vaporized to cause expansion of the bubble, is formed when the border surface 22 between the vapor and the liquid moves to the left in FIG. 6 toward the mouth of the cavity 5 and is kept in contact with the wall surface 23 of the liquid cavity by the viscosity of the liquid and the frictional resistance of the wall surface 23. The layer 24 is very thin and is quickly vaporized by the heat from the wall surface 23, thus maintaining the expansion of the bubble.

Figure 7:
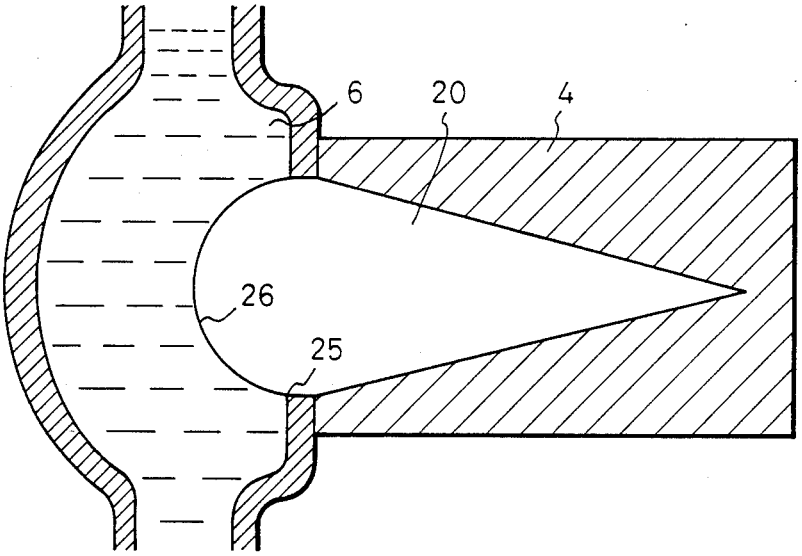

As shown in FIG. 7, when the border surface 22 of the bubble reaches the mouth 25 of the liquid cavity 5, the ends of the vapor-liquid border surface in contact with the wall surface move from the wall face of the heating portion 4 to the wall surface of the vapor-liquid exchange chamber 6 and then stop at that position, causing the wall surface 22 to suddenly expand. The thin layer 24, which is following the border surface 22 between the vapor and the liquid, is vaporized and the bubble continues to grow, and thus the curved vapor-liquid border surface 26 extruding into the vapor-liquid exchange chamber 6 is formed. Since the vapor-liquid exchange chamber 6 has a volume greater than the volume of the extruded bubble, the extruded vapor-liquid border surface 26 does not come into contact with the opposite wall surface of the vapor-liquid exchange chamber 6. The thin layer 24 is then eliminated, and because the wall surface of the vapor-liquid exchange chamber 6 is made from a material having a poor thermal conductivity, new vaporization does not occur and the bubble growth is halted.

Thus, liquid having a volume equivalent to the volume of the bubble is discharged from the liquid cavity 5 to the vapor-liquid exchange chamber 6, and mixed with the liquid therein, thereby raising the temperature of that liquid. Accordingly, the same volume of liquid is discharged from the vapor-liquid exchange chamber 6 to the outside through the discharging pipe 7 and the outlet pipe 9, via the outlet-side check valve 8. The inlet-side check valve 2 is closed by the increased pressure from the vapor-liquid exchange chamber caused by the production of the bubble.

Figure 8:
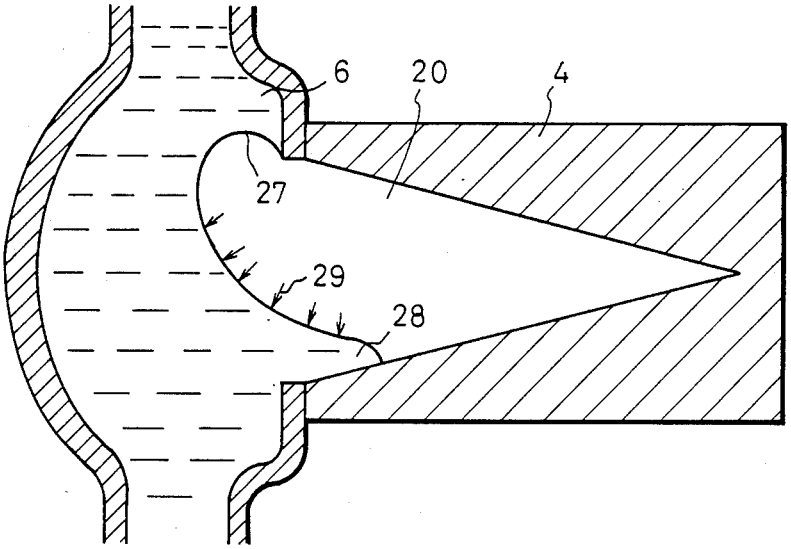

FIG. 8 shows the state in which the upper portion 27 of the extruded part of the bubble is moved upward by the bouyancy thereof, and is replaced by fresh, cold liquid 28 flowing from the vapor-liquid exchange chamber 6 to the liquid cavity 5. The inflow of this cold liquid to the liquid cavity 5 from the vapor-liquid exchange chamber 6 cools the heating portion 4 and the vapor in the bubble is condensed at the vapor-liquid border surface 22, contracting the bubble.

Figure 9:
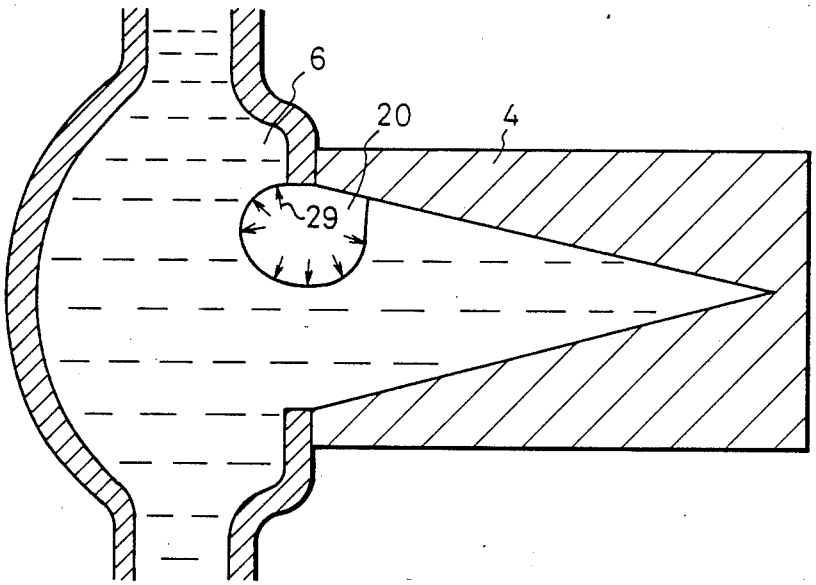

As shown in FIG. 9, because of the negative pressure within the vapor-liquid exchange chamber 6 caused by the contraction of the bubble, the outlet-side check valve 8 is closed and the inlet-side check valve 2 opened, and thus fresh, cold liquid 10 is introduced from the reservoir 11 to the vapor-liquid exchange chamber 6 through the inlet pipe 1 and charging pipe 3 via the inlet-side check valve 2. The contraction process is quickly completed, eliminating the bubble, and fresh cold liquid having the same volume as the volume of the bubble flows into and cools the vapor-liquid exchange chamber 6. The pump is then completely filled by the liquid, and the operation returns to the initial state. The pump then ceases operation until the liquid in the tip portion of the liquid cavity in the heating portion is heated to the saturation point. As previously described, the heat-driven pump carries out an intermittent operation.

In the heat-driven pump shown in FIG. 1, a small quantity of the liquid in the tip of the liquid cavity 5 is heated faster than the liquid in the other portions, and the bubble is produced when the temperature of the small quantity of liquid rises beyond the saturation point. The bubble is expanded by the vaporization of the thin layer 24 of the liquid formed on the wall surface 23 of the liquid cavity 5. Accordingly, a large portion of the liquid within the liquid cavity 5 is discharged into the vapor-liquid exchange chamber 6 by the growth of the bubble at a temperature sufficiently lower than the saturation point. The vapor-liquid exchange chamber 6 is maintained at a temperature sufficiently lower than the saturation point, facilitating the condensation of the bubble extruded from the liquid cavity 5 into the vapor-liquid exchange chamber 6. Further, the volume of the bubble generated and grown in the manner described above is virtually defined by the shape and size of the liquid cavity, regardless of the amount of heat.

Compared with the heat-driven pump of the prior art, the heat-driven pump shown in FIG. 1 consumes less energy to produce a bubble having the same volume. This is because the bubble can be produced by heating only the small portion of the liquid to be vaporized into the bubble. Further, the grown bubble is completely and quickly eliminated by maintaining the vapor-liquid exchange chamber 6 at a low temperature. Therefore, in the heat-driven pump shown in FIG. 1, the ratio of the energy consumed for the pumping function vs. the total energy applied is higher than that of the heat-driven pump in the prior art, namely, the heat-driven pump of the present invention has a high efficiency.

Since the heat-driven pump shown in FIG. 1 requires less energy to generate a bubble than that required by the pump of the prior art, a pumping action caused by the production and elimination of the bubble is still carried out even when only a small amount of heat is applied. Furthermore, the volume of one bubble generated from the liquid cavity is almost constant with regard to the amount of heat applied, and thus the heat-driven pump shown in FIG. 1 can be operated with a large amount of heat by increasing the cycles of bubble generation and elimination.

In the heat-driven pump shown in FIG. 1, different from the heat-driven pump of the prior art, a suction portion exerting a capillary function is not provided in the charging pipe 3, and a large flow amount can be handled by expanding the diameter of the charging pipe 3.

The heat-driven pump shown in FIG. 1 can be installed in any position regardless of whether the tip of the liquid cavity is on a horizontal plane or on a plane which is perpendicular to or aslant of the horizontal plane, provided that bouyancy is exerted on the bubble generated at the liquid cavity 5. Therefore, this heat-driven pump has a greater freedom of installation than the heat-driven pump of the prior art.

Figure 10:
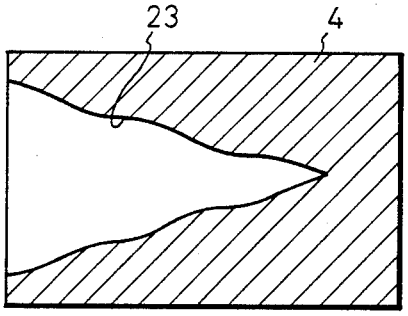
FIGS. 10 and 11 cross-sectional views showing variations of the liquid cavity.

The heating portion 4 may have the shapes shown in FIGS. 10 to 13, other than shown in FIG. 1. FIG. 10 is a cross-sectional view of the heating portion 4 in which the wall surface 23 of the liquid cavity has a configuration defined by a revolution body of a gradual inflection curve. In the heat-driven pump, the production and elimination of a larger bubble causes an increase in the changing amount of the liquid within the vapor-liquid exchange chamber 6 and the vapor-liquid exchange chamber 6 is sufficiently cooled so that the bubble is completely contracted, and thus the pumping operation becomes more stable and the amount of the discharged flow is increased. To generate a larger bubble, the amount of the thin layer 24 of the liquid must be increased. Therefore, as shown in FIG. 10, the wall surface is slightly inflected to increase the surface area thereof.

Figure 11:
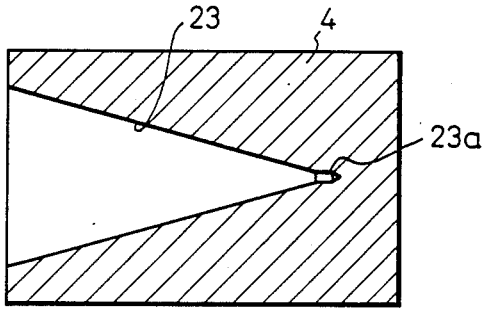

FIG. 11 shows a cone-shaped liquid cavity as shown in FIG. 1 having a small straight hole 23*a*, wherein the liquid in the hole is first vaporized to increase the volume of the vapor. Further, the hole facilitates machining when the liquid cavity is formed by cutting.

Furthermore, if the wall surface of the liquid cavity is made rough like frosted glass, or covered with fine particles, the liquid infiltrates into the roughened surface with the result that the surface area of the liquid film is increased, and thus the amount of vapor is increased. Also, the rough surface exerts a capillary function to facilitate the invasion of liquid into the liquid cavity.

If the size is same, these modified liquid cavities in the heating portion can generate a larger bubble than the non-modified cavity, and the bubble formed extrudes further inside the vapor-liquid exchange chamber, since the size of the cavity exit is same, and thus, a larger bouyancy is given to the bubble. Accordingly, the exchange of the liquid and the vapor is carried out very quickly, and the performance of the pump is improved.

Figure 12:
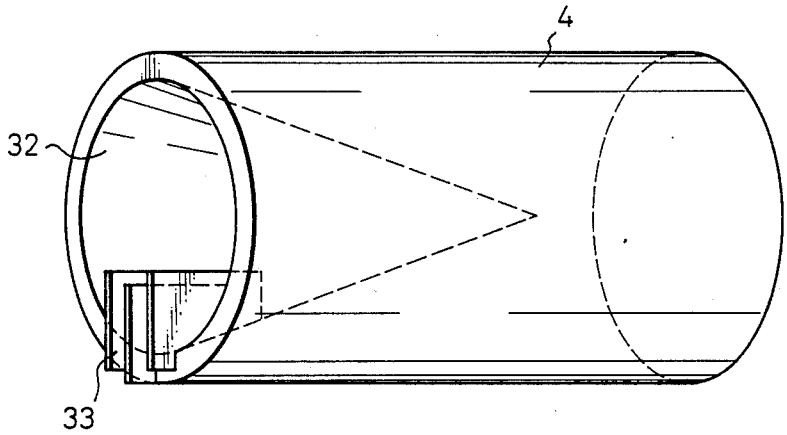
FIGS. 12 and 13 are perspective views showing variations of the liquid cavity exit opening.

FIG. 12 shows the exit 32 of the liquid cavity 5 in the heating portion 4, with a plurality of fins 33 provided at a part of the exit 32. The fins 33 are arranged at intervals such that a capillary action is exerted on the liquid.

Figure 13:
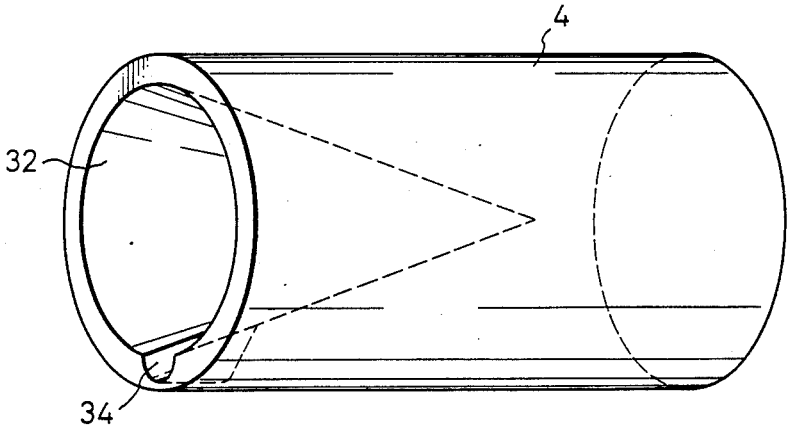

FIG. 13 shows the exit 32 of the liquid cavity in the heating portion 4, and a groove provided at a part of the exit 32. The width of the groove is small enough to ensure that a capillary action is exerted on the liquid.

These modifications assist the invasion of the liquid into the liquid cavity which causes the bubble contraction, and even when the pump is installed at an angle such that the tip of the liquid cavity points is slightly aslant of the horizontal plane, the bubble contraction is carried out, and thus the freedom of installation of the heat-driven pump is expanded.

Figure 14:
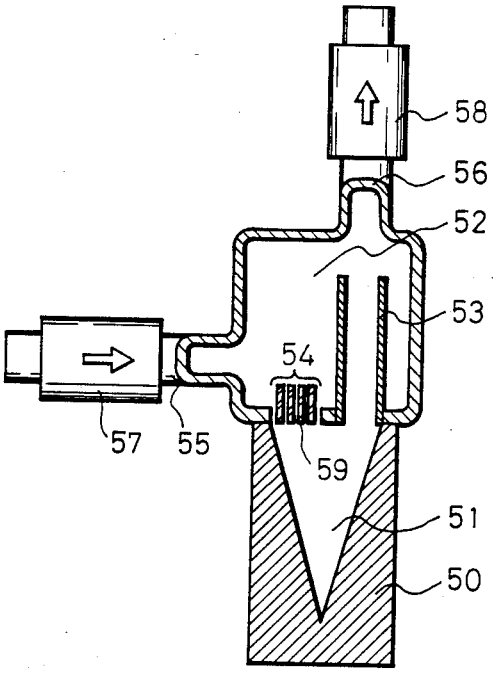
FIG. 14 is a cross-sectional view showing a variation of the heat-driven pump.

Another modified embodiment of the present invention is shown in FIG. 14. The liquid cavity 51 in the heating portion 50 and the vapor-liquid exchange chamber 52 are communicated by two passages which pass through a condensation pipe 53 and a suction portion 54 respectively. The condensation pipe 53 is a thin wall pipe, provided within the vapor-liquid exchange chamber 52, transmitting the heat inside the pipe 53 to the liquid within the exchange chamber 52 adjacent to the condensation pipe 53. The suction portion 54 is provided on the border surface between the heating portion 50 and the vapor-liquid exchange chamber 52 at the space other than occupied by the condensation pipe 53, and a plurality of fins 59 are arranged in parallel to the flow at intervals whereby the capillary function is exerted. The charging pipe 55 and the discharging pipe 56 are formed as one unit with the vapor-liquid exchange chamber 52, and the ends of each of these pipes 55 and 56 are provided with an inlet-side check valve 57 and outlet-side check valve 58 respectively. Other portions are the same as shown in FIG. 1.

Figure 15:
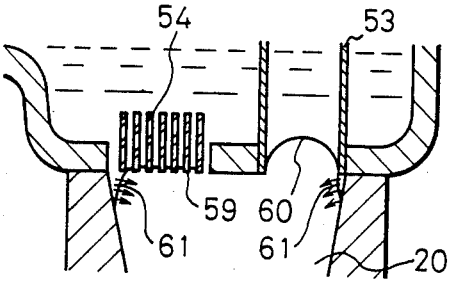
FIG. 15 is a cross-sectional view showing a main portion of the device shown in FIG. 14.

FIG. 15 is an enlarged cross-sectional view of the portion at which the heating portion 50 and the vapor-liquid exchange chamber 52 are communicated, and the liquid cavity is filled with the bubble 20 and the vapor-liquid exchange chamber is filled with the liquid. Here, the border surface 60 between the liquid cavity and the vapor-liquid exchange chamber is invading the condensation pipe 53. The plurality of fins 59 prevents the invasion of the vapor-liquid border surface by a capillary function exerted on the liquid. Accordingly, the bubble enters the condensation pipe 53 only, and at this time, the source of the bubble growth is the vaporization of the thin layer 61 of the liquid, as in the previous case.

The condensation pipe 53 is sufficiently cooled by the liquid within the vapor-liquid exchange chamber so that the bubble in the condensation pipe is immediately condensed. When the bubble starts to contract, the liquid flows from the suction portion 54 to the liquid cavity, cooling the liquid cavity 51 and the heating portion 50, and therefore, the bubble is contracted further and the pressure inside the vapor-liquid exchange chamber becomes negative relative to the pressure outside, then as in the previous case, the outlet-side check valve is closed and the inlet-side check valve is opened, introducing the cold liquid from the reservoir into the vapor-liquid exchange chamber 52 and the liquid cavity 51 through the inlet pipe and the charging pipe via the inlet-side check valve 57, and thus the bubble is eliminated.

In the heat-driven pump of this type, the bubble is contracted by the condensation at the condensation pipe 53, and the pump, which is little affected by gravity, can be installed in any direction. Further, the suction portion 54 utilizing the capillary function, is provided at a place other than the inside of the charging pipe 55, and therefore, no obstacle exists which can restrict the liquid flow from the charging pipe 55 to the discharging pipe 56 via the vapor-liquid exchange chamber 52, so that a large amount of flow is obtained.

Figure 16:
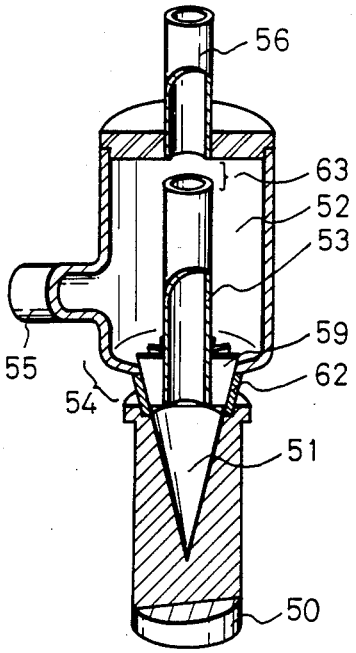
FIG. 16 is a cross-sectional view showing another variation of the heat-driven pump.

FIG. 16 shows another embodiment of the heat-driven pump shown in FIG. 14, wherein the suction portion 54 including the condensation pipe 53 is located at the center portion, a plurality of fins 59 are arranged at the bottom and periphery of the condensation pipe, and a Kovar alloy ring 62 is provided. The heating portion 50, the liquid cavity 51, the vapor-liquid exchange chamber 52, the charging pipe 55, and the discharging pipe 56 are the same as in previous cases. The gap 63 of the condensation pipe 53 having an opening to the vapor-liquid exchange chamber, provides a direct passage for the main flow from the charging pipe to the discharging pipe, and thus the liquid flow by-passes the suction portion 54 and the condensation pipe 53, which are obstacles in the passage. Furthermore, noncondensible bubbles such as air foam, when mixed in the liquid, can be discharged without suction by the liquid cavity 51, and thus a problem such as an operation stoppage by foam is prevented.

Figure 17:
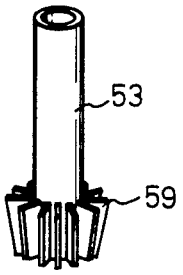
FIG. 17 is a perspective view of the condensation pipe in the device shown in FIG. 16; and, FIG. 18 is a cross-sectional view showing yet another variation of the heat-driven pump.

FIG. 17 shows the condensation pipe 53 and the fins 59 in detail.

Figure 18:
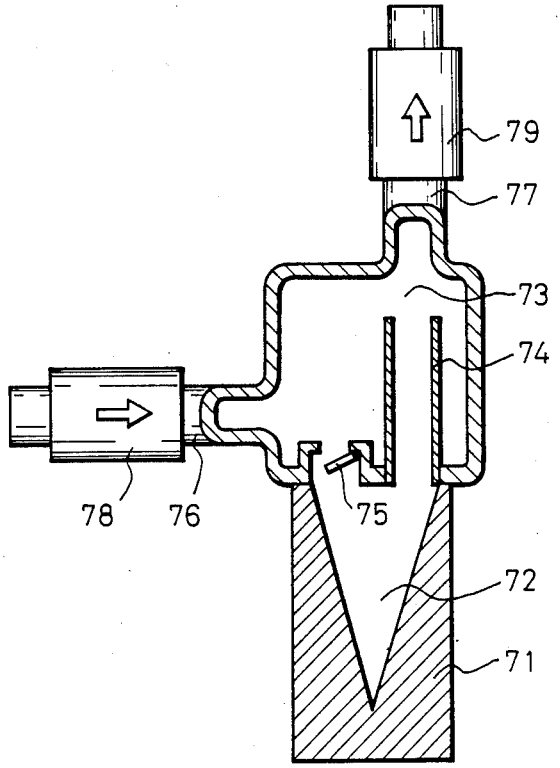

FIG. 18 shows a variation of the heat-driven pump shown in FIG. 14, wherein the check valve 75 is provided in place of the suction portion having a plularity of fins. The arrangement without fins reduces the resistance to the flow, increases the amount of liquid flowing to the liquid cavity 72, and thus allows a bigger cavity to be provided.

In the embodiments of the present invention water is used as the liquid. However, an organic solvent such as alcohol, methanol and acetone; a cooling medium such as ammonia, R-11 and R-12 and a mixture thereof; a liquid metal such as mercury, sodium metal; or any other kind of liquid wherein no solid matter remains when the liquid is vaporized, can be used. An appropriate selection of the liquid allows a variety of heat-driven pumps according to the present invention to be provided for various applications performed at various ranges of temperature.

I claim:

1. A heat-driven pump for transporting liquid by a function of bubbles produced by vaporization and condensation of the liquid under heating, said pump comprising:

a liquid charging portion having a sequence of an inlet pipe, an inlet-side check valve, and a charging pipe;

a bubble forming portion connected to said liquid charging portion for vaporizing and condensating the liquid; and a liquid discharging portion connected to said bubble forming portion and having a sequence of a discharging pipe, an outlet-side check valve and an outlet pipe;

said bubble forming portion comprising:

a vapor-liquid exchange chamber formed between said charging pipe and said discharging pipe by expanding the cross section of said pipes to have a volume greater than the possible maximum volume of a bubble in said chamber; and a heating portion fixed to only one side of said vapor-liquid exchange chamber for receiving heat supplied from outside and having a liquid cavity therein which communicates with said vapor-liquid exchange chamber;

a bubble being generated and developed to drive the liquid to cause the interface of the bubble and liquid to be moved along the internal surface of said liquid cavity to form a thin liquid layer on the internal surface of said liquid cavity to realize a vaporization from said thin liquid layer, wherein the developed bubble is expanded by the received heat into said vapor-liquid exchange chamber, a corresponding volume of liquid in said vapor-liquid exchange chamber is accordingly discharged, the expanded bubble is displaced upwardly by buoyancy exerted on the bubble to cause a deformation of the bubble, an amount of new liquid is introduced into said liquid cavity, and said bubble is eliminated by cooling by said introduced new liquid, so that a successive pumping of the liquid is carried out.

2. A pump according to claim 1, wherein the sequence of said charging pipe of said liquid charging portion, said vapor-liquid exchange chamber of said bubble forming portion, and said liquid discharging pipe of said liquid discharging portion is arranged in a substantially vertical relationship.

3. A pump according to claim 1, wherein said liquid cavity in said heating portion has a variable cross section which decreases along a longitudinal axis of said liquid cavity, said longitudinal axis being substantially horizontal.

4. A pump according to claim 1, wherein an introduction of said new liquid to said liquid cavity is caused by an upward movement of a border surface between the vapor and the liquid caused by a bouyancy exerted on said bubble.

5. A pump according to claim 1, wherein, at a junction between said liquid cavity and said vapor-liquid exchange chamber, there are provided in said vapor-liquid exchange chamber, a condensation pipe for facilitating an invasion of a border surface between the vapor and the liquid, and a suction portion having a plurality of fins for facilitating a capillary function to prevent an invasion of the border surface between the vapor and the liquid in said vapor-liquid exchange chamber.

6. A pump according to claim 1, wherein, at the junction between said liquid cavity and said vapor-liquid exchange chamber, a condensation pipe is provided in said vapor-liquid exchange chamber for facilitating an invasion of the border surface between the vapor and the liquid, and a plurality of fins surround the end portion of said condensation pipe are provided for facilitating the capillary function of the liquid for preventing an invasion of the border surface between the vapor and the liquid.

7. A pump according to claim 1, wherein, at the junction between said liquid cavity and said vapor-liquid exchange chamber, a condensation pipe and a check valve are provided in said vapor-liquid exchange chamber.

* * * * *